US011626022B2

(12) United States Patent
Cheremushkina et al.

(10) Patent No.: US 11,626,022 B2
(45) Date of Patent: Apr. 11, 2023

(54) METHOD, DEVICE, AND SYSTEM FOR DETECTING A DANGEROUS ROAD EVENT AND/OR CONDITION

(71) Applicant: MOTOROLA SOLUTIONS, INC, Chicago, IL (US)

(72) Inventors: Olga Cheremushkina, Saint-Petersburg (RU); Elena Kozlova, Saint-Petersburg (RU); Fedor Grigorievich Savelev, Saint-Petersburg (RU)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 779 days.

(21) Appl. No.: 15/753,472

(22) PCT Filed: Nov. 20, 2015

(86) PCT No.: PCT/RU2015/000806
§ 371 (c)(1),
(2) Date: Feb. 19, 2018

(87) PCT Pub. No.: WO2017/086827
PCT Pub. Date: May 26, 2017

(65) Prior Publication Data
US 2018/0247541 A1 Aug. 30, 2018

(51) Int. Cl.
*G08G 1/00* (2006.01)
*G08G 1/01* (2006.01)
*G07C 5/00* (2006.01)

(52) U.S. Cl.
CPC ..... *G08G 1/205* (2013.01); *G07C 5/008* (2013.01); *G08G 1/0112* (2013.01);
(Continued)

(58) Field of Classification Search
CPC .... G08G 1/205; G08G 1/0129; G08G 1/0133; G08G 1/0112; G08G 1/0141; G07C 5/008
See application file for complete search history.

(56) References Cited

U.S. PATENT DOCUMENTS 7,389,178 B2 6/2008 Raz et al.
8,725,309 B2 5/2014 Kubotani et al.
(Continued)

FOREIGN PATENT DOCUMENTS

GB 2489655 A * 10/2012 ..... G08G 1/0133
WO 2014130178 A1 8/2014

OTHER PUBLICATIONS

The International Search Report and the Written Opinion, corresponding patent application No. PCT/RU2015/000806, filed Nov. 20, 2015, all pages.

*Primary Examiner* — Shon G Foley

(57) ABSTRACT

Dangerous road events and conditions may be detected and responded to. A first report is received including a first location of a first vehicle and a first acceleration associated with the first vehicle beyond a threshold amount. A second report is received including a second location of a second vehicle and a second acceleration associated with the second vehicle beyond the threshold amount. In response to determining that the first and second reports meet a maximum relative time constraint and a maximum relative location constraint: (i) transmitting a notification to a dispatch console indicative of a potential dangerous road event near the first and second locations, (ii) transmitting a dispatch request to a response vehicle to respond to the potential dangerous road event near the first and second locations, or (iii) storing an indication of the potential dangerous road event.

20 Claims, 4 Drawing Sheets

(52) U.S. Cl.
CPC ..... *G08G 1/0129* (2013.01); *G08G 1/0133* (2013.01); *G08G 1/0141* (2013.01)

(56) References Cited

U.S. PATENT DOCUMENTS

| | | | | |
|---|---|---|---|---|
| 8,907,772 | B1 | 12/2014 | Green et al. | |
| 8,952,800 | B2 | 2/2015 | Bantz et al. | |
| 9,047,778 | B1 | 6/2015 | Cazanas et al. | |
| 9,070,290 | B2 | 6/2015 | Taylor | |
| 9,767,625 | B1 * | 9/2017 | Snyder | G01P 15/0891 |
| 2007/0167147 | A1 * | 7/2007 | Krasner | G08G 1/205 455/404.2 |
| 2009/0072997 | A1 | 3/2009 | Shrum, Jr. | |
| 2013/0049987 | A1 | 2/2013 | Velusamy | |
| 2014/0051041 | A1 | 2/2014 | Stefan et al. | |
| 2014/0130178 | A1 | 5/2014 | Agrawal et al. | |
| 2014/0160295 | A1 | 6/2014 | Kyomitsu et al. | |
| 2015/0279122 | A1 * | 10/2015 | Lorenzen | G07B 15/063 705/13 |
| 2015/0344038 | A1 * | 12/2015 | Stenneth | G07C 5/008 340/439 |
| 2015/0356795 | A1 * | 12/2015 | Warren | G07C 5/0808 701/31.5 |
| 2016/0042644 | A1 | 2/2016 | Velusamy | |
| 2016/0135077 | A1 * | 5/2016 | Streijl | H04L 47/127 370/230 |
| 2016/0352846 | A9 * | 12/2016 | Gauglitz | G06Q 50/01 |

* cited by examiner

METHOD, DEVICE, AND SYSTEM FOR DETECTING A DANGEROUS ROAD EVENT AND/OR CONDITION

This application is a National Stage filing under 35 USC § 371 of co-pending Patent Cooperation Treaty international application having Serial No. PCT/RU15/00806 (the 'PCT international application') filed on Nov. 20, 2015. This application claims priority to the PCT international application, the entire contents of which are incorporated herein by reference.

BACKGROUND OF THE INVENTION

Dangerous road events and conditions may impact vehicles on the road and may also impact traffic conditions across interconnecting systems of roads. Such road events and conditions could be caused by defects in the road itself, items or structures on the road, non-optimal traffic management flows, unmanaged pedestrian crossings, or actions taken by other drivers on the road, among other possibilities.

Current systems to address, repair, or otherwise respond to such dangerous road events or conditions generally rely on vehicular users to report the events or conditions by phone, or rely upon random and intermittent patrolling of such roadways by police or other government entities. These current systems result in slow and inconsistent response times in addressing, repairing, or otherwise responding to the dangerous road events or conditions, resulting in unnecessary increases in damage to persons and property.

Thus, there exists a need for an improved method, system, and device for automatically detecting and responding to address such detected dangerous road events and/or conditions in an efficient and intelligent manner.

BRIEF DESCRIPTION OF THE SEVERAL VIEWS OF THE DRAWINGS

The accompanying figures, where like reference numerals refer to identical or functionally similar elements throughout the separate views, which together with the detailed description below are incorporated in and form part of the specification and serve to further illustrate various embodiments of concepts that include the claimed invention, and to explain various principles and advantages of those embodiments.

Figure 1:
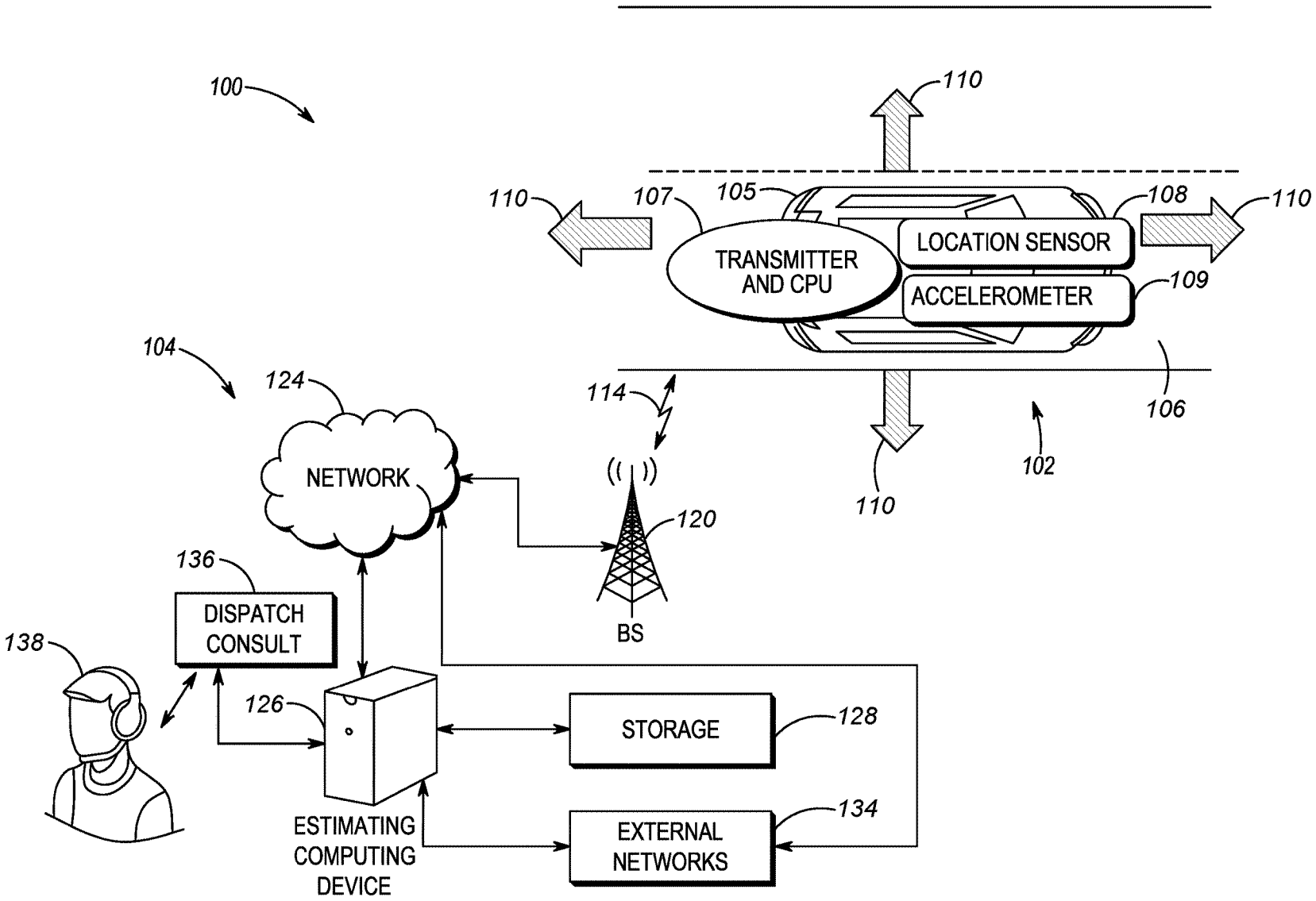
FIG. 1 is a system diagram illustrating an infrastructure wireless network for supporting detection of a dangerous road event and/or condition in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Disclosed is an improved method, device, and system for detecting a dangerous road event and/or condition.

In one embodiment a process for detecting and responding to dangerous road events and conditions includes: receiving, at a computing device, a first report including a first location indication associated with a first location of a first vehicle and a first vehicular acceleration indication associated with an acceleration of the first vehicle beyond a first acceleration threshold amount; receiving, at the computing device, a second report including a second location indication associated with a second location of a second vehicle and a second vehicular acceleration indication associated with an acceleration of the second vehicle beyond a second acceleration threshold amount; and responsive to determining that the first report and second report meet a road event maximum relative time constraint, and that the first location and the second location meet a maximum relative location constraint: one of (i) transmitting, by the computing device, a notification to a dispatch console indicative of a potential dangerous road event near the first and second locations, (ii) transmitting, by the computing device, a dispatch request to a response vehicle instructing the response vehicle to respond to the potential dangerous road event near the first and second locations, and (iii) storing, by the computing device, an indication of the potential dangerous road event near the first and second locations.

In a further embodiment, a computing device for detecting and responding to dangerous road events and conditions includes one or more transceivers; a data store; and one or more electronic processors configured to: receive, via the one or more transceivers, a first report including a first location indication associated with a first location of a first vehicle and a first vehicular acceleration indication associated with an acceleration of the first vehicle beyond a first acceleration threshold amount; receive, via the one or more transceivers, a second report including a second location indication associated with a second location of a second vehicle and a second vehicular acceleration indication associated with an acceleration of the second vehicle beyond a second acceleration threshold amount; and responsive to determining that the first report and second report meet a road event maximum relative time constraint, and that the first location and the second location meet a maximum relative location constraint: one of (i) transmit, via the one or more transceivers, a notification to a dispatch console indicative of a potential dangerous road event near the first and second locations, (ii) transmit, via the one or more transceivers, a dispatch request to a response vehicle instructing the response vehicle to respond to the potential dangerous road event near the first and second locations, and (iii) store, via the data store, an indication of the potential dangerous road event near the first and second locations.

In a still further embodiment, a non-transitory computer readable media storing instructions that, when executed by an electronic processor, perform a set of functions for detecting and responding to dangerous road events and conditions, the set of functions comprising: receiving, via a receiver coupled to the electronic processor, a first report including a first location indication associated with a first location of a first vehicle and a first vehicular acceleration indication associated with an acceleration of the first vehicle beyond a first acceleration threshold amount; receiving, via a receiver coupled to the electronic processor, a second report including a second location indication associated with a second location of a second vehicle and a second vehicular acceleration indication associated with an acceleration of the second vehicle beyond a second acceleration threshold amount; and responsive to determining that the first report and second report meet a road event maximum relative time constraint, and that the first location and the second location meet a maximum relative location constraint: one of (i) transmitting, via a transmitter coupled to the electronic processor, a notification to a dispatch console indicative of a potential dangerous road event near the first and second locations, (ii) transmitting, via a transmitter coupled to the electronic processor, a dispatch request to a response vehicle instructing the response vehicle to respond to the potential dangerous road event near the first and second locations, and (iii) storing, via a data store coupled to the electronic processor, an indication of the potential dangerous road event near the first and second locations.

Each of the above-mentioned embodiments will be discussed in more detail below, starting with example network and device architectures of the system in which the embodiments may be practiced, followed by an illustration of processing and messaging steps for achieving detection of a dangerous road event and/or condition from an estimating server computing device perspective. Further advantages and features consistent with this disclosure will be set forth in the following detailed description, with reference to the figures.

1. System Architecture and Device Structure

Referring now to the drawings, FIG. 1 illustrates a system 100 including an infrastructure wireless communication network for supporting vehicular reporting of potentially dangerous road events and/or conditions in accordance with some embodiments. In particular, FIG. 1 illustrates a vehicular reporting system 102 and an infrastructure wireless communications network 104.

The vehicular reporting system 102 may include a physical vehicle 105 operating on a road 106, a transmitter and electronic processor 107, a location sensor 108, and an accelerometer 109 (each of which may be integrated with a processing unit of the vehicle 105 itself or included in a portable communications device associated with the vehicle 105, a driver of the vehicle 105, or a passenger of the vehicle 105). In the remaining portion of this description, it should be assumed that any reference to a vehicle having a transmitter and processor, location sensor, and accelerometer should refer to the possibility of such functions being integrated within the vehicle electronics itself, or being resident in a portable communication device accompanying the vehicle or a user of the vehicle and being statically or dynamically associated with the vehicle.

The vehicle 105 could be any motor vehicle, including a car, truck, scooter, or motorcycle, under control of a human or computer, and capable of navigating a road 106 in which other vehicles, obstacles, or defects could be encountered.

The transmitter and processor 107 may be any set of transmitter capable of transmitting data in accordance with one or more wireless protocols and a processor capable of receiving information from the location sensor 108 and accelerometer 109, processing and/or packaging the data, and transmitting the data via the transmitter to the infrastructure wireless communications network 104. The transmitter may transmit over wireless link(s) 114 established between the transmitter and processor 107 and a base station (BS) 120 in the infrastructure wireless communications network 104. The wireless protocol used to transmit data and/or control information between transmitter and processor 107 and BS 120 may include, but is not to be limited to, a conventional or trunked land mobile radio (LMR) standard or protocol such as ETSI Digital Mobile Radio (DMR), a Project 25 (P25) standard defined by the Association of Public Safety Communications Officials International (APCO), or any other LMR radio protocols or standards. In other embodiments, the wireless protocol may be a Long Term Evolution (LTE) protocol including multimedia broadcast multicast services (MBMS), an open mobile alliance (OMA) push to talk (PTT) over cellular (OMA-PoC) standard, a voice over IP (VoIP) standard, or a PTT over IP (PoIP) standard. Other types of wireless protocols could be implemented as well. Communications in accordance with any one or more of these protocols or standards, or other protocols or standards, may take place over physical channels in accordance with one or more of a TDMA (time division multiple access), FDMA (frequency divisional multiple access), OFDMA (orthogonal frequency division multiplexing access), or CDMA (code division multiple access) protocol.

The location sensor 108 could be a global positioning system (GPS) or similar sensor for determining a geographic location of the vehicle 105 via a set of three or more orbiting satellites, a processor and receiver for determining a geographic location of the vehicle 105 via a set of three or more signals received from terrestrial wireless transmitting stations (e.g., via triangulation), or some other location determination device or method.

The accelerometer 109 is capable of detecting acceleration along any one or more of the axes 110 illustrated in FIG. 1. The accelerometer is a device that measures acceleration. Single and multi-axis models are available to detect magnitude and direction of the acceleration as a vector quantity, and can be used to sense orientation, acceleration, vibration, shock, and/or falling. Other types of movement sensors could additionally, or alternatively, be used as well.

The infrastructure wireless communications network 104 includes the aforementioned BS 120, a network 124, an estimating computing device 126, an external storage 128, one or more external networks 134, and a dispatch console 136 monitored by a dispatcher 138. The BS 120 may be any fixed terminal (e.g. a repeater, base transceiver station (BTS), or eNodeB, herein referred to as a base station (BS)) for wirelessly communicating with one or more vehicles, such as vehicle 105 via its transmitter and processor 107, using a wireless protocol including one or more of the wireless protocols mentioned above. The BS 120 has at least one radio transmitter covering a radio coverage cell (not shown). One or several portable communications devices or vehicles within radio coverage of the BS 120 may connect to the BS 120 using a wireless communication protocol via wireless link(s) 114. The transmitter and processor 107 of vehicle 105 may communicate with other vehicles and/or portable communications devices and with devices in the infrastructure 104 (such as dispatch console 136), and perhaps other devices accessible via external networks 134, using a group communications protocol over the wireless link(s) 114. Dangerous road condition event reports may also be reported to the estimating computing device 126 via BS 120. Responsive action(s) relating to the dangerous road condition event reports may be transmitted back to vehicles such as vehicle 105 or to other vehicles or portable communications devices associated with, for example, an officer or other first responders via BS 120 as well.

The vehicle 105 or portable communications device associated with the vehicle 105 and reporting location and accelerator information relative to dangerous road events may be configured with an identification reference (such as an International Mobile Subscriber Identity (IMSI) or MAC address) which may be connected to a physical media (such as a Subscriber Identity Module (SIM) card). The identification reference maybe used to distinguish between reports from a same vehicle and other vehicles or from multiple portable communications device within a same vehicle, among other possibilities.

Although only a single estimating computing device 126 is illustrated in FIG. 1, more than one estimating computing device 126 may be used and/or a distributed estimating computing device 126 may be used that divides functions across multiple devices, perhaps for load balancing reasons. Finally, while storage 128 is illustrated as directly coupled to estimating computing device 126, storage 128 may also be disposed internally to estimating computing device 126 or remote from estimating computing device 126 and accessible to estimating computing device 126 via one or more of network 124 and/or external networks 134.

Figure 5:
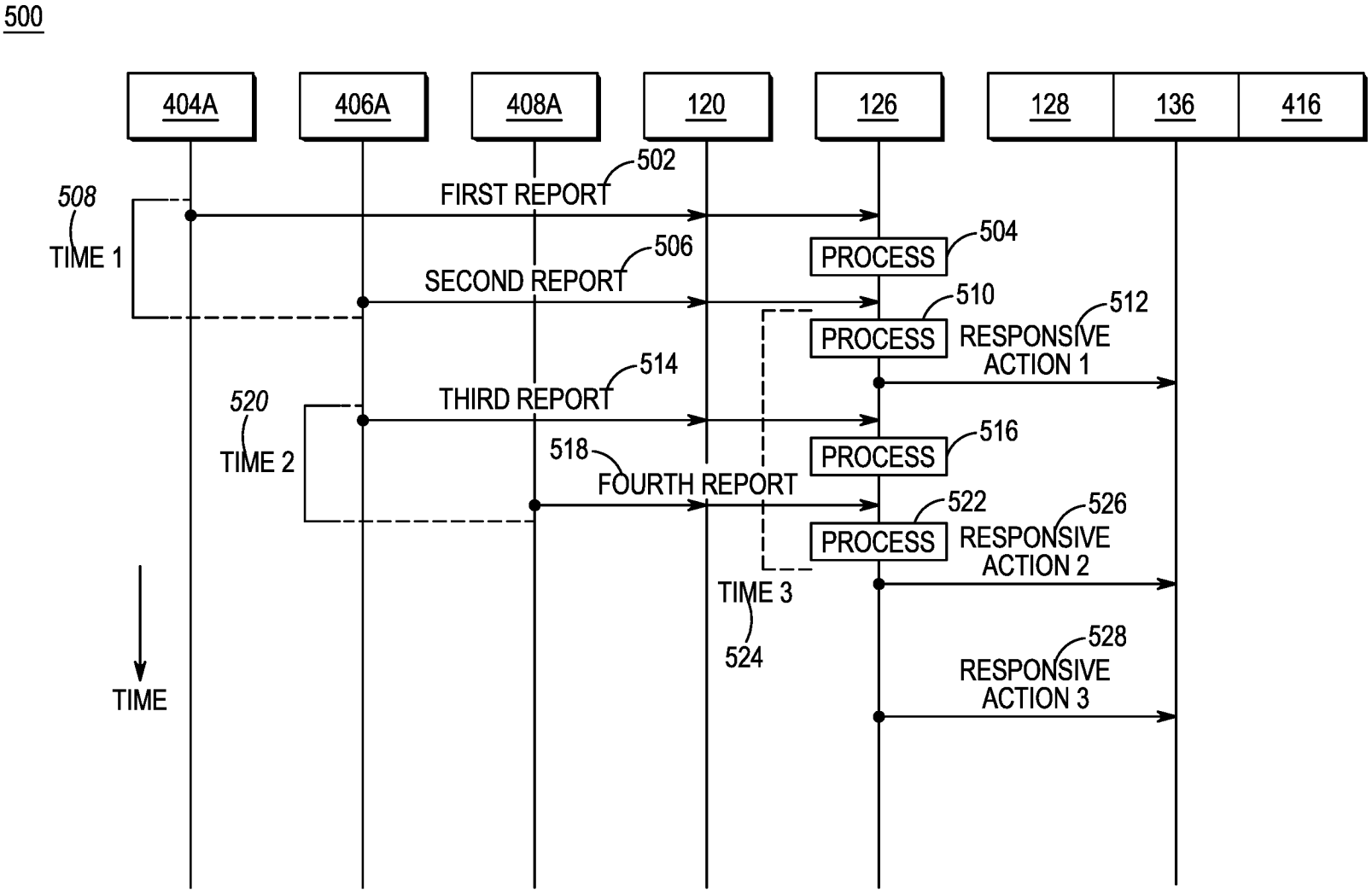
FIG. 5 is a ladder diagram illustrating messaging and processing steps across reporting vehicles, the estimating computing device, and one or more response targets for supporting detection of a dangerous road event and/or condition in accordance with some embodiments, in accordance with some embodiments.

Estimating computing device 126 may be a separate computing device for performing one or more of the steps set forth in FIG. 5 for detecting a dangerous road event and/or condition, or may be integrated into another wireless infrastructure device, including, for example, a call controller, PTT server, zone controller, evolved packet core (EPC), mobile management entity (MME), radio network controller (RNC), base station controller (BSC), mobile switching center (MSC), site controller, Push-to-Talk controller, or other network device for controlling and distributing calls amongst portable communications devices via respective BSs.

The BS 120 may be linked to the estimating computing device 126 via one network 124. Network 124 may comprise one or more routers, switches, LANs, WLANs, WANs, access points, or other network infrastructure. For example, estimating computing device 126 may be accessible to BS 120 via a dedicated wireline or via the Internet.

Storage 128 may function to store location and accelerometer information reported from vehicles for future access and/or further processing, for current access by a dispatcher 138 at dispatch console 136, for access by other mobile vehicles or portable communications units via BS 120 and/or other BSs (not shown), and/or for other reasons.

External networks 134 may also be accessible to BS 120 (and thus to vehicles and associated portable communications devices) via network 124. External networks 134 may include, for example, a public switched telephone network (PSTN), the Internet, or another wireless service provider's network, among other possibilities.

Dispatch console 136 may be directly coupled to estimating computing device 126 as shown, or may be indirectly coupled to estimating computing device 126 via one or more of network 124 and external networks 134. Dispatch console 136 provides dispatcher 138 access to vehicles and other portable communications devices accessible via BS 120 or other BSs, and allows an additional avenue for estimating computing device 126 to report detected potentially dangerous road events and/or conditions for further action and/or dispatch of proper vehicles or responders to remedy the dangerous road event or condition.

Figure 2:
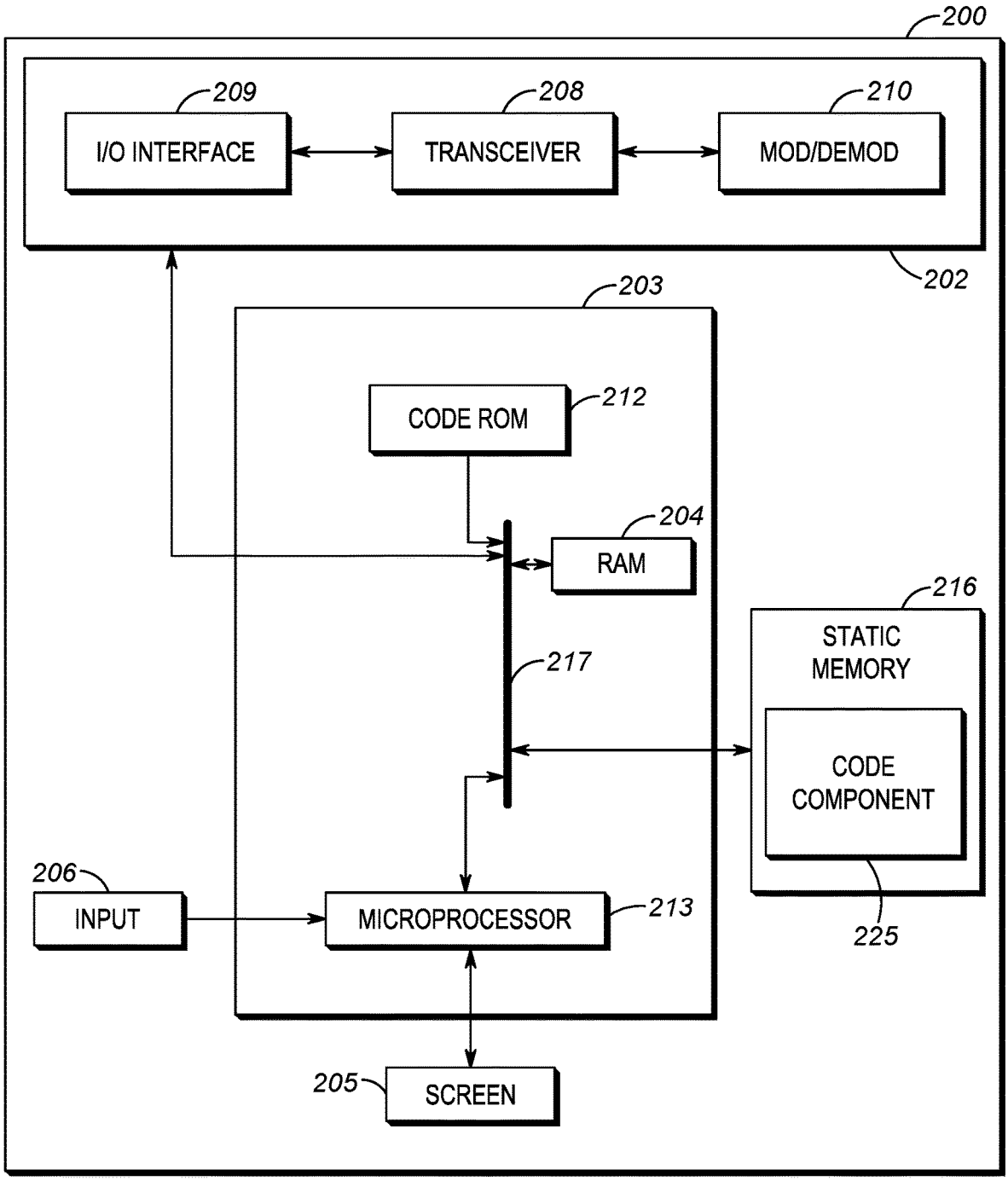
FIG. 2 is a device diagram showing a device structure of the estimating computing device of FIG. 1 in accordance with some embodiments.

Referring to FIG. 2, a schematic diagram illustrates an estimating computing device 200 according to some embodiments of the present disclosure. Estimating computing device 200 may be, for example, the same as or similar to the estimating computing device 126 of FIG. 1. As shown in FIG. 2, estimating computing device 200 includes a communications unit 202 coupled to a common data and address bus 217 of a processing unit 203. The estimating computing device 200 may also include an input unit (e.g., keypad, pointing device, etc.) 206 and a display screen 205, each coupled to be in communication with the processing unit 203.

The processing unit 203 may include a code Read Only Memory (ROM) 212 coupled to the common data and address bus 217 for storing data for initializing system components. The processing unit 203 may further include an electronic microprocessor 213 coupled, by the common data and address bus 217, to a Random Access Memory (RAM) 204 and a static memory 216.

The communications unit 202 may include one or more wired or wireless input/output (I/O) interfaces 209 that are configurable to communicate with other devices in network 124, other devices via BS 120, dispatch console 136, storage 128, and/or external networks 134, among others.

The communications unit 202 may include one or more wireless transceivers 208, such as a DMR transceiver, a P25 transceiver, a Bluetooth transceiver, a Wi-Fi transceiver perhaps operating in accordance with an IEEE 802.11 standard (e.g., 802.11a, 802.11b, 802.11g), a WiMAX transceiver perhaps operating in accordance with an IEEE 802.16 standard, and/or other similar type of wireless transceiver configurable to communicate via a wireless radio network. The communications unit 202 may additionally or alternatively include one or more wireline transceivers 208, such as an Ethernet transceiver, a Universal Serial Bus (USB) transceiver, or similar transceiver configurable to communicate via a twisted pair wire, a coaxial cable, a fiber-optic link, or a similar physical connection to a wireline network. The transceiver 208 is also coupled to a combined modulator/demodulator 210.

The microprocessor 213 has ports for coupling to the input unit 206 and to the display screen 205. Static memory 216 may store operating code 225 for the microprocessor 213 that, when executed, performs one or more of the estimating computing device processing, transmitting, and/or receiving steps set forth in FIG. 5 and accompanying text. Static memory 216 may also store, permanently or temporarily, vehicular report information received from vehicles, including location and accelerometer information stored therein.

Static memory 216 may comprise, for example, a hard-disk drive (HDD), an optical disk drive such as a compact disk (CD) drive or digital versatile disk (DVD) drive, a solid state drive (SSD), a tape drive, a flash memory drive, or a tape drive, to name a few.

2. Processes for Detecting a Dangerous Road Event and/or Condition

Figure 3:
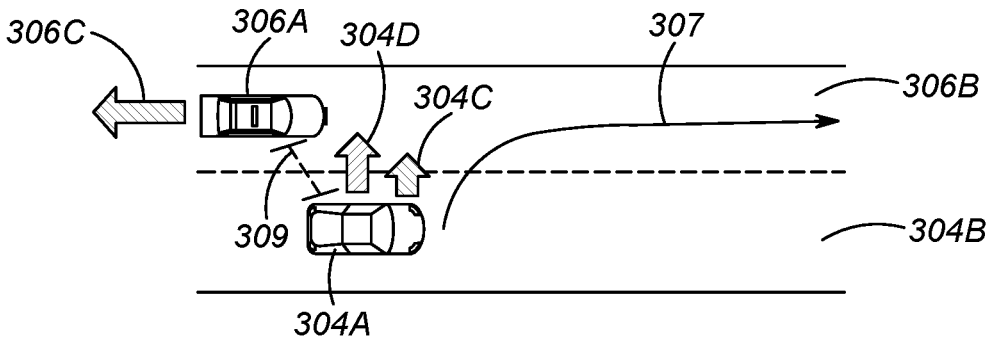
FIG. 3 is a schematic diagram illustrating an example in which a potential dangerous road event would not be reported and/or detected, in accordance with some embodiments.
Figure 4:
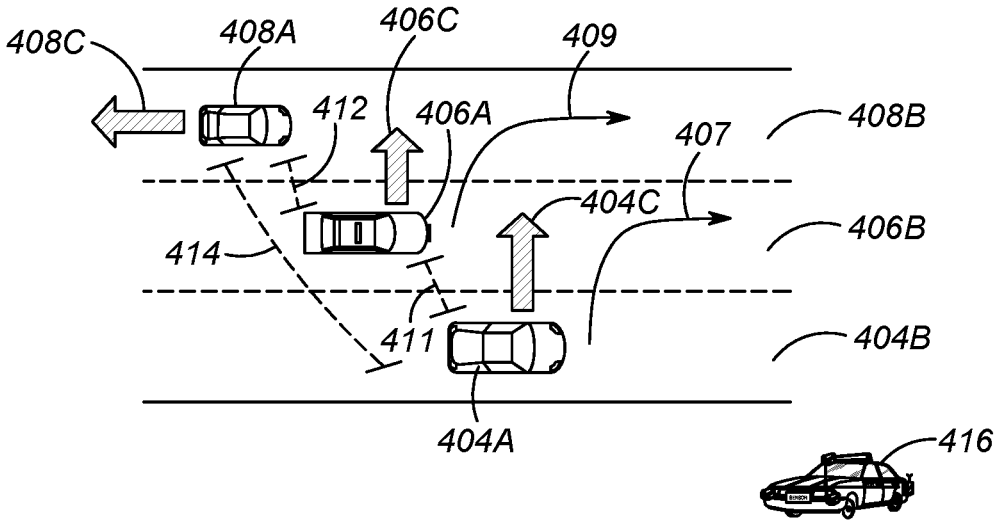
FIG. 4 a schematic diagram illustrating an example in which a potential dangerous road event would be reported and/or detected, in accordance with some embodiments.

Turning now to FIGS. 3 and 4, schematic diagrams illustrate examples in which a potential dangerous road event would not and would be reported and/or detected, in accordance with some embodiments. FIG. 3 sets forth a schematic diagram illustrating an example road event that would not result in a report being generating indicating a potential dangerous road event, while FIG. 4 sets forth a schematic diagram illustrating an example road event that would result in a report being generating indicating a potential dangerous road event.

Starting first with FIG. 3, this schematic diagram illustrates two vehicles 304A and 306A traveling along a two-lane road from left to right. The first vehicle 304A is initially traveling in the lower lane 304B, while the second vehicle 306A is initially traveling in the upper lane 306B in a position slightly behind the first vehicle 304A in the direction of travel of the vehicles, and the vehicles are a distance 309 apart. Each of vehicles 304A and 306A include same or similar transmitter and electronic processor 107, location sensor 108, and accelerometer 109 as vehicle 105 of FIG. 1. In this example, as time progresses vehicle 304A makes a smooth lane-change along arrow 307 to move from the lower lane 304B to the upper lane 306B. In a first example, the accelerometer in the vehicle 304A records an acceleration 304C in the direction indicated in FIG. 3 that is below a threshold associated with an evasive or aggressive maneuver. In one example, the vehicle 304A determines that the detected acceleration 304C is below the threshold and simply refrains from reporting it. In other embodiments, the vehicle 304A may always transmit any non-nominal change in acceleration to the estimating computing device in the wireless infrastructure communications network, and may rely upon the estimating computing device to determine whether the detected acceleration 304C meets the threshold. The acceleration threshold amount may be in the range of 1.5-8 $m/s^2$. For example, the detected acceleration 304C may be less than 1.5 $m/s^2$.

In response to vehicle 304A changing lanes along path 307, vehicle 306A has to slightly de-accelerate 306C (e.g., coasting or a slight tap on brakes) to avoid getting too close to vehicle 304A now in lane 306B. Vehicle 306A, similar to vehicle 304A, either determines that the detected acceleration 306C is below the acceleration threshold and simply refrains from reporting it, or reports it and relies upon the estimating computing device to determine that the detected acceleration 306C is below the acceleration threshold.

In the example of FIG. 3 above, because neither one of the detected accelerations 304C or 306C are determined to be above a threshold acceleration value, such as above 1.5-8 $m/s^2$ or above 3-6 $ms/^2$, the estimating computing device does not determine that there is any potential dangerous road event as a result of vehicle 304A's movement along path 307 and vehicle 306A's slight de-acceleration. Furthermore, even if vehicle 304A executed a more abrupt lane change in which vehicle 304A detects or reports an acceleration change 304D above the acceleration threshold, absent a corroborating detected report from another vehicle such as vehicle 306A, estimating computing device 126 of FIG. 1 would still fail to detect or determine that there is a potentially dangerous road event or condition near the locations of vehicles 304A and/or 306A.

Moving on to FIG. 4, this schematic diagram illustrates three vehicles 404A, 406A, and 408A traveling along a three-lane road from left to right. The first vehicle 404A is initially traveling in the lower lane 404B, the second vehicle 406A is initially traveling in the middle lane 406B in a position slightly behind the first vehicle 404A in the direction of travel of the vehicles, and the third vehicle 408A is initially traveling in the upper lane 408B in a position slightly behind the second vehicle 406A in the direction of travel of the vehicles. The first vehicle 404A and the second vehicle 406A are a distance 411 apart, the second vehicle 406A and the third vehicle 408A are a distance 412 apart, and the first vehicle 404A and the third vehicle 408A are a distance 414 apart.

Each of vehicles 404A, 406A, 408A include same or similar devices 107-109 as vehicle 105 of FIG. 1. In this example, vehicle 404A makes an abrupt lane-change along arrow 407 to move from the lower lane 404B to the upper lane 406B. In a first example, the accelerometer in the vehicle 404A records an acceleration 404C in the direction indicated in FIG. 4 that is above a threshold associated with an evasive or aggressive maneuver. In one example, the vehicle 404A determines that the detected acceleration 404C is above the threshold and reports it (e.g., an indication that the threshold has been exceeded and/or the actual value of the detected acceleration 404C that exceeded the threshold) to the estimating computing device 126 of FIG. 1. In other embodiments, the vehicle 404A may always transmit any non-nominal change in acceleration to the estimating computing device 126 in the wireless infrastructure communications network 104, and may rely upon the estimating computing device 126 to determine that the detected acceleration 404C exceeds the acceleration threshold. The acceleration threshold amount may be in the range of greater than 6 or greater than 8 $m/s^2$. So, for example, detected acceleration 404C may be 8.5 $m/s^2$. Vehicle 404A also reports its absolute location at or substantially near (e.g., less than 1 s from) the time that the acceleration threshold was exceeded.

In response to vehicle 404A abruptly changing lanes along path 407, vehicle 406A abruptly changes lanes along path 409 to avoid contact with vehicle 404A. Vehicle 406A similarly either determines that the detected acceleration 406C is above the acceleration threshold and reports it (e.g., an indication that the threshold has been exceeded and/or the actual value of the detected acceleration 406C that exceeded the threshold) to the estimating computing device 126 of FIG. 1, or reports the actual value and relies upon the estimating computing device to determine that the detected acceleration 406C is above the acceleration threshold. A same or similar acceleration threshold of 8 $m/s^2$ as other vehicles may be applied at vehicle 406A or at estimating computing device 126. For example, the detected acceleration 406C may be approximately 8.2 $m/s^2$. Vehicle 406A also reports its absolute location at or substantially near (e.g., less than is from) the time that the acceleration threshold was exceeded.

In response to vehicle 406A abruptly changing lanes along path 409, vehicle 408A abruptly breaks to avoid contact with vehicle 406A. Vehicle 408A similarly either determines that the detected acceleration 408C is above the acceleration threshold and reports it (e.g., an indication that the threshold has been exceeded and/or the actual value of the detected acceleration 408C that exceeded the threshold) to the estimating computing device 126 of FIG. 1, or reports the actual value and relies upon the estimating computing device to determine that the detected acceleration 408C is above the acceleration threshold. A different but similar acceleration threshold as the other vehicles of 7 $m/s^2$ may be applied at vehicle 408A or at estimating computing device 126. For example, the detected acceleration 408C may be approximately 7.2 $m/s^2$. The different acceleration thresholds may be applied to different types of vehicles (e.g., car vs. truck vs. motorcycle) and/or to different makes/models of the same type of vehicle, perhaps varying by characteristics of that make/model. Vehicle 406A also reports its absolute location at or substantially near (e.g., less than is from) the time that the acceleration threshold was exceeded.

In the example of FIG. 4 above, because (i) vehicle 404A's report of an acceleration exceeding a first threshold was corroborated by one or more other vehicles 406A, 408A reporting same or similar acceleration thresholds being exceeded, (ii) each of the reports was generated or received at the BS 120 or estimating computing device 126 of FIG. 1 within a road event maximum relative time constraint of one another, and (iii) each of the vehicles 404A, 406A, and 408A report locations within a threshold maximum distance of one another at or substantially near the time of detecting the exceeding acceleration (e.g., distances 411, 412, and/or 414 are within a predetermined maximum distance from one another, as statically or dynamically set at the estimating computing device 126), the estimating computing device determines that there is a potential dangerous road event at or near the locations of the vehicles 404A, 406A, 408A.

The road event maximum relative time constraint determination may be based on a timestamp generated by each vehicle and reported along with, or just before or just after, the indication of the acceleration exceeding the threshold. Additionally or alternatively, the road event maximum relative time constraint determination may be based on a timestamp attached to the report upon receipt by the BS 102, the estimating computing device 126 of FIG. 1, or some other computing device in wireless communications network 104. The road event maximum relative time constraint may be, for example, equal to or less than 60 seconds, 30 seconds, or 10 seconds. The maximum relative location constraint may be equal to or less than 100 meters, 50 meters, or 25 meters. The purpose of the road event maximum relative time constraint and the maximum relative location constraint is to ensure that a detected potential dangerous road event is caused by a same event, and is thus corroborated across multiple vehicles at substantially a same moment in time and at substantially a same location.

Responsive to detecting a potential dangerous road event, the estimating computing device 126 of FIG. 1 may take a follow-up investigative or corrective action. For example, the estimating computing device 126 may transmit a notification to a dispatch console 136 informing the dispatcher 138 of the potential dangerous road event near the first, second, and/or third locations of vehicles 404A, 406A, 408A (e.g., all reported locations, just one of the reported locations such as a first or a last location reported and still within the location threshold, or an average of the reported locations), (ii) transmitting a dispatch request to a response vehicle such as vehicle 416 of FIG. 4 instructing the response vehicle to respond to the potential dangerous road event near the near the first, second, and/or third locations of vehicles 404A, 406A, 408A, and (iii) storing an indication (including one or more of acceleration values, time of day, day of week, determined weather conditions, location, etc.) of the potential dangerous road event near the near the first, second, and/or third locations of vehicles 404A, 406A, 408A for future access, analysis, and/or aggregation.

While three vehicles 404A, 406A, 408A were used in the example of FIG. 4, in other embodiments, only two vehicles may report, and in still further embodiments, more than three vehicles may report. Further, although a lane change was used as an example in FIG. 4, in other embodiments, any other type of condition or event could cause vehicles to begin reporting accelerations exceeding thresholds, such as a large pothole, an animal or pedestrian in the road, a fallen tree on the road, an existing single or multi-car accident, and non-optimal construction traffic flows, among other possibilities.

FIG. 5 is a ladder diagram illustrating a process 500 for detecting a dangerous road event and/or condition including messaging and processing steps across first, second, and third reporting vehicles 404A, 406A, 408A, the BS 120, the estimating computing device 126, and one or more responsive action targets 128, 138, 416, in accordance with some embodiments.

Process 500 begins with the first vehicle 404A transmitting a first report 502 of a potential dangerous road event to estimating computing device 126 via BS 120. As set forth above, the first report 502 includes an indication of a detected acceleration along some axis or combination of axes above a threshold amount, and/or includes the actual detected acceleration value above the threshold amount. The first report 502 also includes a location of the first vehicle 404A as determined by the vehicle 404A. In some embodiments, the location of the vehicle 404A could, instead, be determined via a triangulation process on the wireless signals associated with the transmission of the first report 502 or on other transmitted signals, using three or more BSs (not shown) to triangulate the location of the first vehicle 404A, and reporting the triangulated position to the estimating computing device 126. Still further, the first report 502 includes a unique identifier identifying one of the vehicle 404A and a portable communications device associated with the vehicle 404A.

At step 504, the estimating computing device 126 receives and processes the first report 502. Step 504 may include storing the first report 502 in a storage integrated within the estimating computing device 126 or in a storage 128 external to the estimating computing device 126. In some embodiments, the estimating computing device 126 may receive multiple first reports from multiple portable communications devices all within the same vehicle 404A. In order to avoid counting each report as a separate incident, since in fact they are all related as being within the same vehicle, estimating computing device 126 may filter reports at step 504 to aggregate, combine, or elect a single one of multiple reports having substantially the same detected location (e.g., within 5 or 10 feet), substantially the same time of detection or receipt (e.g., within 1 or 5 seconds), and substantially the same value of detected acceleration and direction of acceleration (e.g., within 5% or 10% of the value and within 5 degrees or 10 degrees of the direction).

Subsequently, second vehicle 406A transmits a second report 506 of a potential dangerous road event to estimating computing device 126 via BS 120. As set forth above, the second report 506 includes an indication of a detected acceleration along some axis or combination of axes above a threshold amount, and/or includes the actual detected acceleration value above the threshold amount. The second report 506 also includes a location of the second vehicle 406A as determined by the vehicle 406A. In some embodiments, the location of the vehicle 406A could, instead, be determined via a triangulation process. Still further, the second report 506 includes a unique identifier identifying one of the vehicle 406A and a portable communications device associated with the vehicle 406A. The second report is generated by the second vehicle 406A, sent by the second vehicle 406A, or received by the BS 120 or estimating computing device 126 within a time period 508 of the first report 502 being respectively generated by the first vehicle 404A, sent by the first vehicle 404A, or received by the BS 120 or the estimating computing device 126.

At step 510, the estimating computing device 126 receives and processes the second report 506. Step 506 may include storing the second report 506 in a storage integrated within the estimating computing device 126 or in a storage 128 external to the estimating computing device 126. In some embodiments, the estimating computing device 126 may receive multiple second reports from multiple portable communications devices all within the same vehicle 406A. In order to avoid counting each report as a separate incident, since in fact they are all related as being within the same vehicle, estimating computing device 126 may filter reports at step 510 to aggregate, combine, or elect a single one of multiple reports having substantially the same detected location (e.g., within 5 or 10 feet), substantially the same time of detection or receipt (e.g., within 1 or 5 seconds), and/or substantially the same value of detected acceleration and direction of acceleration (e.g., within 5% or 10% of the value and within 5 degrees or 10 degrees of the direction).

Also at step 510, the estimating computing device 126 determines if the second report 506 can be correlated with any other previously received reports. In other words, the estimating computing device 126 determines if another report was received within a road event maximum relative time constraint of the second report 506 reporting a potential dangerous road condition at a location within a maximum relative location constraint of the second report.

In this example, the estimating computing device 126 determines that the first report 502 was received within a time period 508 less than a road event maximum relative time constraint. The estimating computing device 126 may make the time constraint determination in a number of ways, including but not limited to, comparing a timestamp of when the first report 502 was generated relative to a timestamp of when the second report 506 was generated, comparing a timestamp of when the first report 502 was received at BS 120 compared to when the second report 506 was received at BS 120, and comparing a timestamp of when the first report 502 was received at the estimating computing device 126 compared to when the second report 506 was received at the estimating computing device 126, among other possibilities.

In this example, the estimating computing device 126 also determines that the first report 502 indicates a location that is within the maximum relative location constraint relative to the location indicated in the second report 506. The location of the first vehicle 404A may have been determined by the first vehicle and included in the first report 502, or could have been determined by the infrastructure, as set forth above. The location of the second vehicle 406A may have been similarly determined. Having both vehicle locations, the estimating computing device 126 may then determine that the vehicle locations are less than the maximum relative location constraint apart.

In some embodiments, because the estimating computing device filtered the reports to ensure that they were not from multiple devices within a same vehicle, estimating computing device may ensure that there are two distinct vehicular events represented by the two reports. While in this example only two reports are transmitted relating to a single event, in other embodiments, three or more reports could be received.

In any event, at step 510 the estimating computing device 126 has two or more distinct reports from distinct vehicles experiencing above-threshold acceleration within a maximum location constraint and within a road event maximum relative time constraint, and can conclude that there is an enhanced probability of a dangerous road event near the locations of the reporting vehicles 404A, 406A. In response to making that determination, the estimating computing device 126 may take a responsive action, including but not limited to, (i) transmitting a notification in a ResponsiveAction1 512 message to a dispatch console 136 indicative of a potential dangerous road event near the first and second locations in a manner such as that already recited above, (ii) transmitting a dispatch request in a ResponsiveAction1 512 message to a response vehicle 416 determined to be near the first and/or second locations instructing the response vehicle 416 to respond to the potential dangerous road event near the first and second locations in a manner such as that already set forth above, and (iii) storing, by a ResponsiveAction1 512 data message to storage 128, an indication of the potential dangerous road event near the first and second locations in a manner such as that already set forth above.

In the example above, if the estimating computing device 126 had not received the second report 506 within the road event maximum relative time constraint (and no other reports associated with a same location as the first report 502), the estimating computing device 126 may consider the first report 502 an anomaly, perhaps generated due to a distracted driver of the vehicle 404A or a random event not requiring a response or further investigation, and would discard the first report 502 without taking any further action.

Returning to the example set forth in FIG. 5, the second vehicle 406A subsequently transmits a third report 514 to estimating computing device 126 via BS 120 while at substantially a same location as the first and second reports 502, 506, but at a period of time later that is greater than the road event maximum relative time constraint (e.g., this is a new event being reported, perhaps related or unrelated to the first event detected at step 510, but at substantially a same location as the first event detected at step 510). While the second vehicle 406A is being reused in this example for ease of illustration purposes, the third report 514 could just as well have been generated and reported by an entirely new vehicle not illustrated in FIG. 4 or 5. At step 516, the estimating computing device processes the third report 514 in substantially the same manner as the first report 502.

Vehicle 408A then transmits a fourth report 518 to estimating computing device 126 via BS 120 while at substantially a same location as the first, second, and third reports 502, 506, 514 at a time period 520 after the third report 514 that is within a road event maximum relative time constraint of the third report 514. At step 522, the estimating computing device processes the fourth report 518 in substantially the same manner as the second report 506, the estimating computing device 126 determining that it has two or more reports from vehicles experiencing above-threshold acceleration within a maximum location constraint and within a road event maximum time constraint, and concluding that there is an enhanced probability of a dangerous road event near the locations of the reporting vehicles 406A, 408A. In response to making that determination, the estimating computing device 126 may again take some sort of responsive action, including but not limited to, (i) transmitting a notification in a ResponsiveAction2 526 message to a dispatch console 136 indicative of a potential dangerous road event near the first and second locations in a manner such as that already recited above, (ii) transmitting a dispatch request in a ResponsiveAction2 526 message to a response vehicle 416 determined to be near the location or locations indicated in the first-fourth reports instructing the response vehicle 416 to respond to the potential dangerous road event in a manner such as that already set forth above, and (iii) storing, by a ResponsiveAction2 526 data message to storage 128, an indication of the potential dangerous road event in a manner such as that already set forth above.

In addition to, or in place of ResponsiveAction2 526, and in response to the estimating computing device 126 determining there is an enhanced probability of a dangerous road event with respect to substantially a same geographic location (e.g., across first, second, third, and fourth reports 502, 506, 514, 518 all associated with substantially a same location) in two or more separate events (e.g., in step 510 and in step 522) and within a second time period 520 less than a road condition maximum relative time constraint, the estimating computing device 126 may determine that a more serious road condition exists near the location or locations associated with the first-fourth reports, and may take some sort of responsive action. Responsive actions may include, but are not limited to, (i) transmitting a notification in a ResponsiveAction3 528 message to a dispatch console 136 indicative of a potential dangerous road condition near the location or locations associated with the first-fourth reports in a manner such as that already recited above, (ii) transmitting a dispatch request in a ResponsiveAction3 528 message to a response vehicle 416 determined to be near the location or locations indicated in the first-fourth reports instructing the response vehicle 416 to respond to the potential dangerous road condition in a manner such as that already set forth above, and (iii) storing, by a ResponsiveAction3 528 data message to storage 128, an indication of the potential dangerous road condition near the location or locations associated with the first-fourth reports in a manner such as that already set forth above. The road condition is considered a more dangerous condition than a single event because it is being repeated a number of times in separate incidents over a period of time. Accordingly, the road condition may be caused by something less ephemeral and more indicative of a structural condition with the road or surrounding area than a dangerous road event. The road condition maximum relative time constraint is larger than the road event maximum relative time constraint and is, for example, equal to or less than 48 hours.

Accordingly, in some embodiments, the ResponsiveAction1 512 and ResponsiveAction2 526 messages associated with a dangerous road event may be less important and may, by default, result in automatic storage of the indication at storage 128 or automatic transmission and display of a yellow or other medium-importance indicator at dispatch console 136. On the other hand, the ResponsiveAction3 528 message, associated with a dangerous road condition, may be more important and may, by default, result in automatic dispatch to a first responder vehicle 416 near the location of the dangerous road condition or automatic transmission and display of a red or other high-importance visual indicator at dispatch console 136.

3. Conclusion

In accordance with the foregoing, an improved method, device, and system is disclosed for detecting a dangerous road event and/or condition. As a result, dangerous road events and conditions may be detected more quickly and remedied more efficiently. Other advantages and benefits are possible as well.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. The benefits, advantages, solutions to problems, and any element (s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized electronic processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising an electronic processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation. The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A method for detecting and responding to dangerous road events and conditions, the method comprising:

receiving, at a computing device, a first report including a first location indication associated with a first location of a first vehicle and a first vehicular acceleration indication associated with a first detected acceleration of the first vehicle at the first location;

receiving, at the computing device, a second report including a second location indication associated with a second location of a second vehicle, different from the first vehicle, and a second vehicular acceleration indication associated with a second detected acceleration of the second vehicle at the second location; and responsive to determining, by the computing device, that the first detected acceleration of the first vehicle exceeds a first acceleration threshold amount, that the second detected acceleration of the second vehicle exceeds a second acceleration threshold amount, that the first report and second report meet a road event maximum relative time constraint relative to one another that is equal to or less than 30 seconds, and that the first location in the first report and the second location in the second report meet a maximum relative location constraint relative to one another:

one of (i) transmitting, by the computing device, a notification to a dispatch console indicative of a potential dangerous road event and a need to dispatch a response vehicle to respond to the potential dangerous road event near the first and second locations, and (ii) transmitting, by the computing device, a dispatch request to the response vehicle instructing the response vehicle to respond to the potential dangerous road event near the first and second locations; and wherein determining that the first report and the second report meet the road event maximum relative time constraint relative to one another that is equal to or less than 30 seconds comprises one of (i) determining that a timestamp generated by the respective first and second vehicles and included in the respective first and second reports are within 30 seconds or less of one another, and (ii) determining that a timestamp of receipt of the respective first and second reports from the respective first and second vehicles generated at the computing device or other same intervening network device between the computing device and the vehicles are within 30 seconds or less of one another; and wherein at least one (i) the first detected acceleration is along an axis substantially perpendicular to a direction of travel of the first vehicle and (ii) the second detected acceleration is along an axis substantially perpendicular to a direction of travel of the second vehicle.

2. The method of claim 1, wherein the first report includes a first unique identifier identifying one of the first vehicle and a wireless device associated with the first vehicle, wherein the first location indication is a geographic location of the first vehicle at a time the first detected acceleration of the first vehicle exceeded the first acceleration threshold amount, and a detected value of the first detected acceleration of the first vehicle exceeding the first acceleration threshold amount.

3. The method of claim 2, wherein the second report includes a second unique identifier identifying one of the second vehicle and a wireless device associated with the second vehicle, wherein the second location indication is a geographic location of the second vehicle at a time the second detected acceleration of the second vehicle exceeded the second acceleration threshold amount, and a detected value of the second detected acceleration of the second vehicle exceeding the second acceleration threshold amount.

4. The method of claim 1, wherein the first acceleration threshold amount and the second acceleration threshold amount are the same, and is in the range of 1.5-8 $m/s^2$.

5. The method of claim 1, wherein, responsive to determining that the first report and second report meet the road event maximum relative time constraint, and that the first location and the second location meet the maximum relative location constraint:

transmitting, by the computing device, the notification to the dispatch console indicative of the potential dangerous road event near the first and second locations for dispatch of proper vehicles or responders to remedy the dangerous road event or condition.

6. The method of claim 1, wherein, responsive to determining that the first report and second report meet the road event maximum relative time constraint, and that the first location and the second location meet the maximum relative location constraint:

transmitting, by the computing device, the dispatch request to the response vehicle instructing the response vehicle to respond to the potential dangerous road event near the first and second locations, wherein the response vehicle is a selected response vehicle out of a plurality of response vehicles determined to be nearest the first and second locations.

7. The method of claim 1, wherein, responsive to determining that the first report and second report meet the road event maximum relative time constraint, and that the first location and the second location meet the maximum relative location constraint:

storing, by the computing device, the indication of the potential dangerous road event near the first and second locations along with timestamps associated with times in which the first and second respective reports were received by one of the computing device and another electronic device in a same infrastructure network as the computing device.

8. The method of claim 1, further comprising receiving, at the computing device, a third report including a third location indication associated with a third location of a third vehicle and a third vehicular acceleration indication associated with a third detected acceleration of the third vehicle beyond a third acceleration threshold amount; and responsive to determining that the road event maximum relative time constraint has passed without receiving another report within the maximum relative location constraint of the third location, discarding the third report.

9. The method of claim 1, further comprising, at a time greater than the road event maximum relative time constraint after receiving the second report:

receiving, at the computing device, a third report including a third location indication associated with a third location of a third vehicle and a third vehicular acceleration indication associated with an acceleration of the third vehicle beyond a third acceleration threshold amount;

receiving, at the computing device, a fourth report including a fourth location indication associated with a fourth location of a fourth vehicle and a fourth vehicular acceleration indication associated with an acceleration of the fourth vehicle beyond a fourth acceleration threshold amount;

responsive to determining that the third report and fourth report meet the road event maximum relative time constraint, that the first, second, third, and fourth locations meet the maximum relative location constraint, and that the first, second, third, and fourth reports meet a road condition maximum relative time constraint:

one of (i) transmitting, by the computing device, a notification to a dispatch console indicative of a potential dangerous road condition near the first, second, third, and fourth locations, (ii) transmitting, by the computing device, a dispatch request to a vehicle instructing the vehicle to respond to the potential dangerous road condition near the first, second, third, and fourth locations, and (iii) storing, by the computing device, an indication of the potential dangerous road condition including the first, second, third, and fourth detected accelerations and the first, second, third, and fourth locations.

10. The method of claim 9, wherein the road condition maximum relative time constraint is equal to or less than 48 hours.

11. A computing device for detecting and responding to dangerous road events and conditions, the computing device comprising:

one or more transceivers;

a data store; and one or more electronic processors configured to:

receive, via the one or more transceivers, a first report including a first location indication associated with a first location of a first vehicle and a first vehicular acceleration indication associated with a first detected acceleration of the first vehicle at the first location;

receive, via the one or more transceivers, a second report including a second location indication associated with a second location of a second vehicle, different from the first vehicle, and a second vehicular acceleration indication associated with a second detected acceleration of the second vehicle at the second location; and responsive to determining that the first detected acceleration of the first vehicle exceeds a first acceleration threshold amount, that the second detected acceleration of the second vehicle exceeds a second acceleration threshold amount, that the first report and second report meet a road event maximum relative time constraint relative to one another that is equal to or less than 30 seconds, and that the first location in the first report and the second location in the second report meet a maximum relative location constraint relative to one another:

one of (i) transmit, via the one or more transceivers, a notification to a dispatch console indicative of a potential dangerous road event and a need to dispatch a response vehicle to respond to the potential dangerous road event near the first and second locations, and (ii) transmit, via the one or more transceivers, a dispatch request to the response vehicle instructing the response vehicle to respond to the potential dangerous road event near the first and second locations; and wherein determining that the first report and the second report meet the road event maximum relative time constraint relative to one another that is equal to or less than 30 seconds comprises one of (i) determining that a timestamp generated by the respective first and second vehicles and included in the respective first and second reports are within 30 seconds or less of one another, and (ii) determining that a timestamp of receipt of the respective first and second reports from the respective first and second vehicles generated at the computing device or other same intervening network device between the computing device and the vehicles are within 30 seconds or less of one another; and wherein at least one (i) the first detected acceleration is along an axis substantially perpendicular to a direction of travel of the first vehicle and (ii) the second detected acceleration is along an axis substantially perpendicular to a direction of travel of the second vehicle.

12. The computing device of claim 11, wherein the first report includes a first unique identifier identifying one of the first vehicle and a wireless device associated with the first vehicle, wherein the first location indication is a geographic location of the first vehicle at a time the first detected acceleration of the first vehicle exceeded the first acceleration threshold amount, and a detected value of the first detected acceleration of the first vehicle exceeding the first acceleration threshold amount.

13. The computing device of claim 12, wherein the second report includes a second unique identifier identifying one of the second vehicle and a wireless device associated with the second vehicle, wherein the second location indication is a geographic location of the second vehicle at a time the second detected acceleration of the second vehicle exceeded the second acceleration threshold amount, and a detected value of the second detected acceleration of the second vehicle exceeding the second acceleration threshold amount.

14. The computing device of claim 11, wherein the one or more electronic processors are configured to, responsive to determining that the first report and second report meet the road event maximum relative time constraint, and that the first location and the second location meet the maximum relative location constraint:

transmit, via the one or more transceivers, the notification to the dispatch console indicative of the potential dangerous road event near the first and second locations for dispatch of proper vehicles or responders to remedy the dangerous road event or condition.

15. The computing device of claim 11, wherein the one or more electronic processors are configured to, responsive to determining that the first report and second report meet the road event maximum relative time constraint, and that the first location and the second location meet the maximum relative location constraint:

transmit, via the one or more transceivers, the dispatch request to the response vehicle instructing the response vehicle to respond to the potential dangerous road event near the first and second locations, wherein the response vehicle is a selected response vehicle out of a plurality of response vehicles determined to be nearest the first and second locations.

16. A non-transitory computer readable media storing instructions that, when executed by an electronic processor, perform a set of functions for detecting and responding to dangerous road events and conditions, the set of functions comprising:

receiving, via a receiver coupled to the electronic processor, a first report including a first location indication associated with a first location of a first vehicle and a first vehicular acceleration indication associated with a first detected acceleration of the first vehicle at the first location;

receiving, via a receiver coupled to the electronic processor, a second report including a second location indication associated with a second location of a second vehicle, different from the first vehicle, and a second vehicular acceleration indication associated with a second detected acceleration of the second vehicle at the second location; and responsive to determining, by the electronic processor, that the first detected acceleration of the first vehicle exceeds a first acceleration threshold amount, that the second detected acceleration of the second vehicle exceeds a second acceleration threshold amount, that the first report and second report meet a road event maximum relative time constraint relative to one another that is equal to or less than 30 seconds, and that the first location in the first report and the second location in the second report meet a maximum relative location constraint relative to one another:

one of (i) transmitting, via a transmitter coupled to the electronic processor, a notification to a dispatch console indicative of a potential dangerous road event and a need to dispatch a response vehicle to respond to the potential dangerous road event near the first and second locations, and (ii) transmitting, via a transmitter coupled to the electronic processor, a dispatch request to the response vehicle instructing the response vehicle to respond to the potential dangerous road event near the first and second locations; and wherein determining that the first report and the second report meet the road event maximum relative time constraint relative to one another that is equal to or less than 30 seconds comprises one of (i) determining that a timestamp generated by the respective first and second vehicles and included in the respective first and second reports are within 30 seconds or less of one another, and (ii) determining that a timestamp of receipt of the respective first and second reports from the respective first and second vehicles generated at the computing device or other same intervening network device between the computing device and the vehicles are within 30 seconds or less of one another; and wherein at least one (i) the first detected acceleration is along an axis substantially perpendicular to a direction of travel of the first vehicle and (ii) the second detected acceleration is along an axis substantially perpendicular to a direction of travel of the second vehicle.

17. The computing device of claim 11, the one or more electronic processors further configured to:

receive a third report including a third location indication associated with a third location of a third vehicle and a third vehicular acceleration indication associated with a third detected acceleration of the third vehicle beyond a third acceleration threshold amount; and responsive to determining that the road event maximum relative time constraint has passed without receiving another report within the maximum relative location constraint of the third location, discard the third report.

18. The computing device of claim 11, the one or more electronic processors further configured to, at a time greater than the road event maximum relative time constraint after receiving the second report:

receive a third report including a third location indication associated with a third location of a third vehicle and a third vehicular acceleration indication associated with an acceleration of the third vehicle beyond a third acceleration threshold amount;

receive a fourth report including a fourth location indication associated with a fourth location of a fourth vehicle and a fourth vehicular acceleration indication associated with an acceleration of the fourth vehicle beyond a fourth acceleration threshold amount;

responsive to determining that the third report and fourth report meet the road event maximum relative time constraint, that the first, second, third, and fourth locations meet the maximum relative location constraint, and that the first, second, third, and fourth reports meet a road condition maximum relative time constraint:

one of (i) transmit, via the one or more transceivers, a notification to a dispatch console indicative of a potential dangerous road condition near the first, second, third, and fourth locations, (ii) transmit, via the one or more transceivers, a dispatch request to a vehicle instructing the vehicle to respond to the potential dangerous road condition near the first, second, third, and fourth locations, and (iii) store, via the data store, an indication of the potential dangerous road condition including the first, second, third, and fourth detected accelerations and the first, second, third, and fourth locations.

19. The method of claim 1, wherein both (i) the first detected acceleration is along the axis substantially perpendicular to the direction of travel of the first vehicle and (ii) the second detected acceleration is along the axis substantially perpendicular to the direction of travel of the second vehicle.

20. The computing device of claim 11, wherein both (i) the first detected acceleration is along the axis substantially perpendicular to the direction of travel of the first vehicle and (ii) the second detected acceleration is along the axis substantially perpendicular to the direction of travel of the second vehicle.

* * * * *